US008714415B2

(12) United States Patent
Rech et al.

(10) Patent No.: US 8,714,415 B2
(45) Date of Patent: May 6, 2014

(54) SPRAYER FOR LIQUIDS

(75) Inventors: Gilberto Rech, Rossano Veneto (IT); Sarlo Buti, Bassano del Grappa (IT)

(73) Assignee: MWV-Vicenza S.p.A., Vicenza (IT)

( * ) Notice: Subject to any disclaimer, the term of this patent is extended or adjusted under 35 U.S.C. 154(b) by 60 days.

(21) Appl. No.: 13/057,103

(22) PCT Filed: Jul. 8, 2009

(86) PCT No.: PCT/EP2009/004920

§ 371 (c)(1), (2), (4) Date: Feb. 1, 2011

(87) PCT Pub. No.: WO2010/015304

PCT Pub. Date: Feb. 11, 2010

(65) Prior Publication Data

US 2011/0174843 A1 Jul. 21, 2011

(30) Foreign Application Priority Data

Aug. 6, 2008 (IT) ..... MI2008A1485

(51) Int. Cl.
*B67D 7/58* (2010.01)

(52) U.S. Cl.
USPC ..... 222/376; 222/382; 222/383.1; 222/464.1

(58) Field of Classification Search
USPC ..... 222/383.1, 376, 382, 464.1, 321.4, 222/402.19
See application file for complete search history.

(56) References Cited

U.S. PATENT DOCUMENTS

| | | | | | |
|---|---|---|---|---|---|
| 3,315,693 | A * | 4/1967 | Braun | 137/43 |
| 3,379,136 | A * | 4/1968 | Corsette | 417/313 |
| 4,775,079 | A * | 10/1988 | Grothoff | 222/321.4 |
| 5,341,967 | A * | 8/1994 | Silvenis | 222/376 |
| 5,462,209 | A * | 10/1995 | Foster et al. | 222/376 |
| 5,467,901 | A * | 11/1995 | Foster et al. | 222/376 |
| 5,540,360 | A * | 7/1996 | Foster et al. | 222/376 |
| 5,628,434 | A * | 5/1997 | Foster et al. | 222/383.1 |
| 5,645,221 | A * | 7/1997 | Foster | 239/333 |
| 5,803,319 | A * | 9/1998 | Smith et al. | 222/402.19 |
| 5,845,820 | A * | 12/1998 | Foster | 222/383.1 |
| 5,906,301 | A * | 5/1999 | Foster | 222/383.1 |
| 6,186,372 | B1 * | 2/2001 | Garcia et al. | 222/402.19 |
| 6,293,441 | B1 * | 9/2001 | Tasaki et al. | 222/376 |
| 6,386,399 | B1 * | 5/2002 | Tsujii et al. | 222/376 |
| 7,175,056 | B2 * | 2/2007 | Buti | 222/383.1 |
| 7,938,299 | B2 * | 5/2011 | Fahy et al. | 222/382 |
| 2006/0289679 | A1 * | 12/2006 | Johnson et al. | 239/333 |
| 2008/0277430 | A1 * | 11/2008 | Maas et al. | 222/376 |
| 2011/0036871 | A1 * | 2/2011 | Tada et al. | 222/383.1 |

FOREIGN PATENT DOCUMENTS

| | | |
|---|---|---|
| CN | 2518602 | 10/2002 |
| EP | 1029598 A | 8/2000 |
| JP | 11128795 A | 5/1999 |

OTHER PUBLICATIONS

International Search Report for PCT/EP2009/004920 dated Oct. 21, 2009.

* cited by examiner

*Primary Examiner* — Kevin P Shaver
*Assistant Examiner* — Nicholas J Weiss
(74) *Attorney, Agent, or Firm* — MeadWestvaco Intellectual Property Group

(57) ABSTRACT

A sprayer for liquids including a USD (Upside Down) device which allows operation of the sprayer in the upright and upside down positions.

15 Claims, 6 Drawing Sheets

SPRAYER FOR LIQUIDS

CROSS-REFERENCE TO RELATED APPLICATIONS

This application is a National Phase application of PCT Application PCT/EP2009/004920 entitled "SPRAYER FOR FLUIDS," filed 8 Jul. 2009, which claims the benefit of Italian Application MI2008A001485 filed 6 Aug. 2008, each of which are incorporated herein by reference in their entireties.

The present invention refers to a sprayer for liquids, in particular a pump sprayer operated manually by means of a trigger lever, with an integrated USD (upside down) device which allows delivery of the product even when the sprayer is in an upside-down position.

A sprayer generally comprises a main body provided with a base with a threaded ferrule or with a bayonet coupling to be applied to the mouth of a container for liquids, a delivery nozzle from which the liquid is sprayed, a trigger lever that can be manually operated by the user, and a pump that can be operated by the trigger lever to draw the liquid from the container by means of a dip tube and spray it through the delivery nozzle.

The pump has a piston acting in a chamber formed in the body of the sprayer. The body of the sprayer further comprises an inlet duct that puts the inside of the fluid container into communication with the pump chamber and an outlet duct that puts the pump chamber into communication with the sprayer nozzle. Within or immediately upstream of the pump chamber there is a fluid suction and delivery valve adapted to allow the fluid to be sucked selectively in a one-way manner from the container to the pump chamber and delivery of the fluid from the pump chamber towards the delivery nozzle.

A sprayer with a built-in USD device, to which the invention refers, allows dispensing of the liquid even in an upside-down position, that is, with the dip tube protruding beyond the liquid held in the container, when said container is in an upside-down position.

Examples of sprayers of this type are described for example in EP 968767 A1, EP 867229 A1 and WO 2006/101388 A1.

The sprayers described in the cited documents have two main drawbacks:

1. Numerous additional components are necessary for operation in an upright and upside-down position, with a consequent increase in the manufacturing cost of the sprayer;
2. A USD valve assembly is present in the area beneath the body of the sprayer which requires a dedicated filling and assembly line (container-product-sprayer), or else the dimensions of these sprayers in said area are such as to require often costly modifications to the filling lines already installed.

Object of the invention is to eliminate the above mentioned drawbacks, by providing a sprayer with a USD device, that is, capable of operating even in an upside-down position, with the components necessary to perform this function reduced to a minimum, and thus limiting the increases in the cost of the product.

Another object of the invention is that of providing such a sprayer that is able to adapt to existing filling lines without requiring economically significant changes.

Yet another object of the invention is that of providing such a sprayer that is simple and cheap in design and can if necessary be transformed into a sprayer without a USD function.

The above mentioned objects are achieved by the sprayer according to the invention which presents the features of appended independent claim 1.

Advantageous embodiments of the invention are set forth in the dependent claims.

Essentially, in the sprayer according to the invention, there is provided behind the pump body a cavity or cylindrical chamber communicating at the bottom with the channel for sucking the liquid from the container through the dip tube, and having in its side wall slots which put it into communication with the inside of the container.

In this cylindrical cavity, which is closed at the top, there is housed a ball, which in normal conditions of use of the sprayer (Up position) is disposed on a conical surface provided near the bottom of the cavity, closing the duct communicating with the liquid suction channel, and thus preventing the liquid drawn from the container during operation of the pump from being able to flow into the cylindrical cavity.

In the upside down operating condition (Down position) the ball moves to the other end of the cylindrical cavity, freeing the suction channel and allowing the liquid to flow out therefrom through the above mentioned slots provided in the side wall of the cylindrical cavity, following the depression created by operation of the pump.

Further characteristics of the invention will be made clearer by the detailed description that follows, referring to purely exemplary and therefore non limiting embodiments thereof, illustrated in the appended drawings, wherein.

Figure 1:
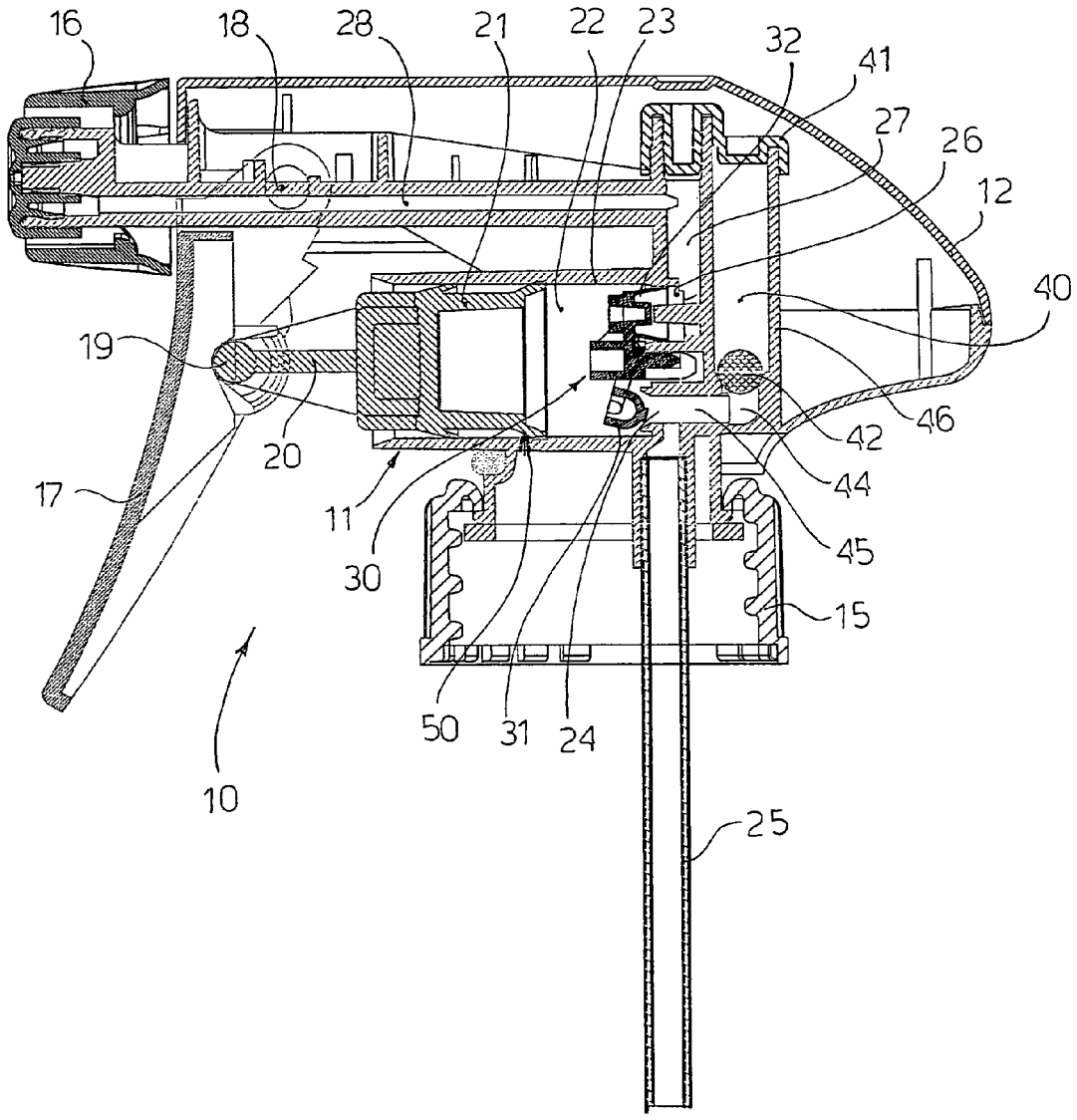
FIG. 1 is median sectional view of a sprayer according to the invention in the upright operating condition (Up position)

The appended figures show a sprayer structure as described in European patent EP 1585602 in the name of the same applicant to which reference can be made for greater details on operation of the sprayer, which will be described herein only summarily.

The sprayer according to the invention, designated as a whole with reference numeral 10, comprises a body 11 closed by a covering cap 12.

A fixing ferrule 15, having an inner thread suitable to engage with an outer thread of the mouth of a container (not shown), suitable for containing a liquid such as, for example, household cleaning liquids, is rotatably mounted at a base of the body 11. Of course, fixing of the sprayer on the container can also take place in a different manner, for example by means of a bayonet coupling.

The body 11 of the sprayer is substantially L-shaped and ends in a spray nozzle 16 with an opening from which the liquid is dispensed.

A trigger lever 17, hinged at one end 18 to the body 11 and in an intermediate portion 19 to the stem 20 of a plunger 21, slidable in a chamber 22 of a pump body 23, is provided for operating the sprayer. A hole for entry of the liquid 24, in communication with the inside of the container through a dip tube 25, and an outlet hole 26, in communication with the spray nozzle 16, through a vertical duct 27 and a horizontal duct 28, are formed in the rear wall of the chamber 22.

The aforesaid liquid inlet and outlet holes 24 and 26 are shut off respectively by a dome portion 31 and a frustoconical tang of a one-way suction and delivery valve 30.

Operation of the one-way valve, described better in the aforementioned patent EP 1585602 is fairly intuitive.

On pressing the trigger lever 17, the liquid in the chamber 22 of the pump exerts pressure against the valve 30, deforming the frustoconical tang 32 and then exiting through the outlet hole 26 to travel towards the spray nozzle 16.

When the trigger lever 17 is released and returns the resting position through the action of elastic means not described, the plunger 21 creates a vacuum in the chamber 22, freeing the inlet hole 24, as shown in FIG. 1, causing the liquid sucked from the container to flow into the chamber 22.

What is described thus far is to be considered known from the aforesaid patent EP 1585602.

According to the invention, to make the sprayer thus far described into a sprayer of the USD (Up-Side-Down) type, there is provided behind the pump body 23 a cylindrical chamber 40, integral with the pump body 11 which extends parallel to and in contact with the vertical portion 27 of the liquid outlet duct.

The chamber 40 is closed at the top by a stopper 41, which in the embodiment shown in FIG. 1 also closes the vertical portion 27 of the liquid outlet duct.

Figure 5:
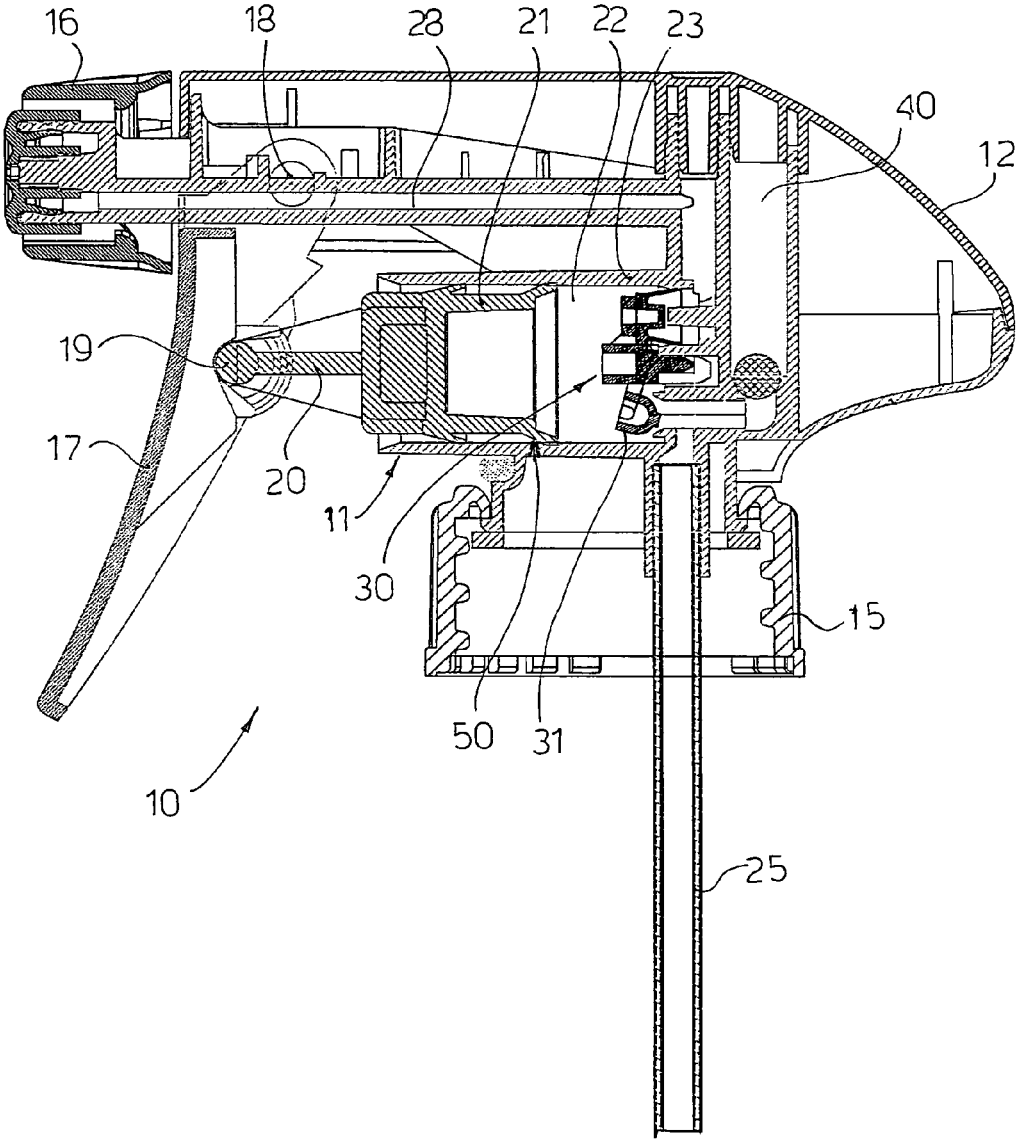
FIG. 5 is a view like that of FIG. 1, showing a different closing modality for the chamber with USD device.

Of course other solutions can be provided to close the chamber 40, and a possible alternative is shown in FIG. 5, in which the stopper 41 is formed integrally with the closing cap 12.

In the chamber 40 there is disposed a ball 42, preferably of plastic material, which in normal operating conditions of the sprayer (Up position—FIG. 1) is tightly housed on a conical seat 43, closing a hole 44 provided on the bottom of said chamber, which puts it into communication with the inlet hole 24 of the pump chamber, through a short horizontal duct 45.

Figure 3:
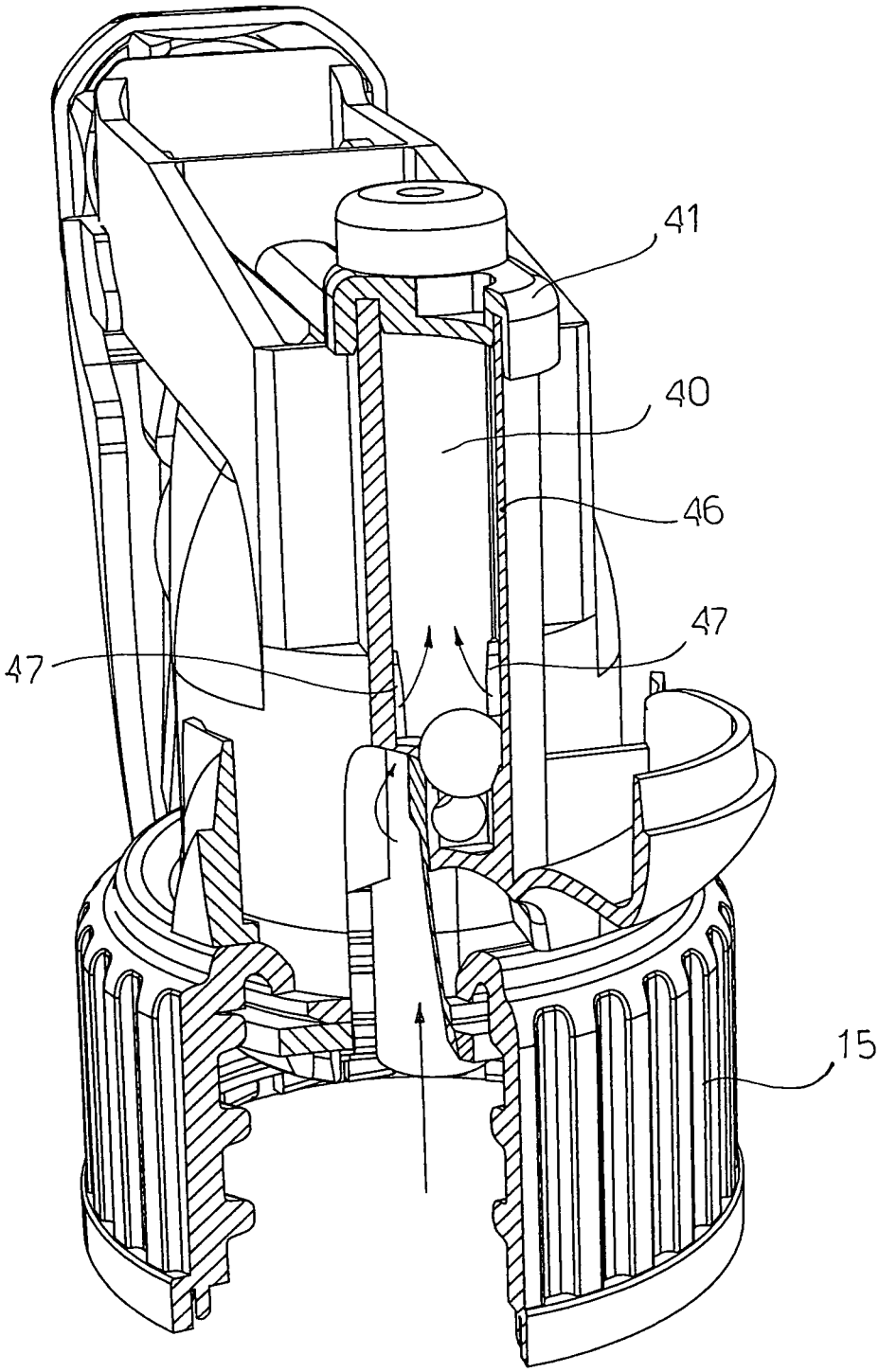
FIGS. 3 and 4 are axonometric views of the sprayer according to the invention, without the covering cap and with parts in a cutaway view, shown in the upright and upside-down position, respectively.
Figure 4:
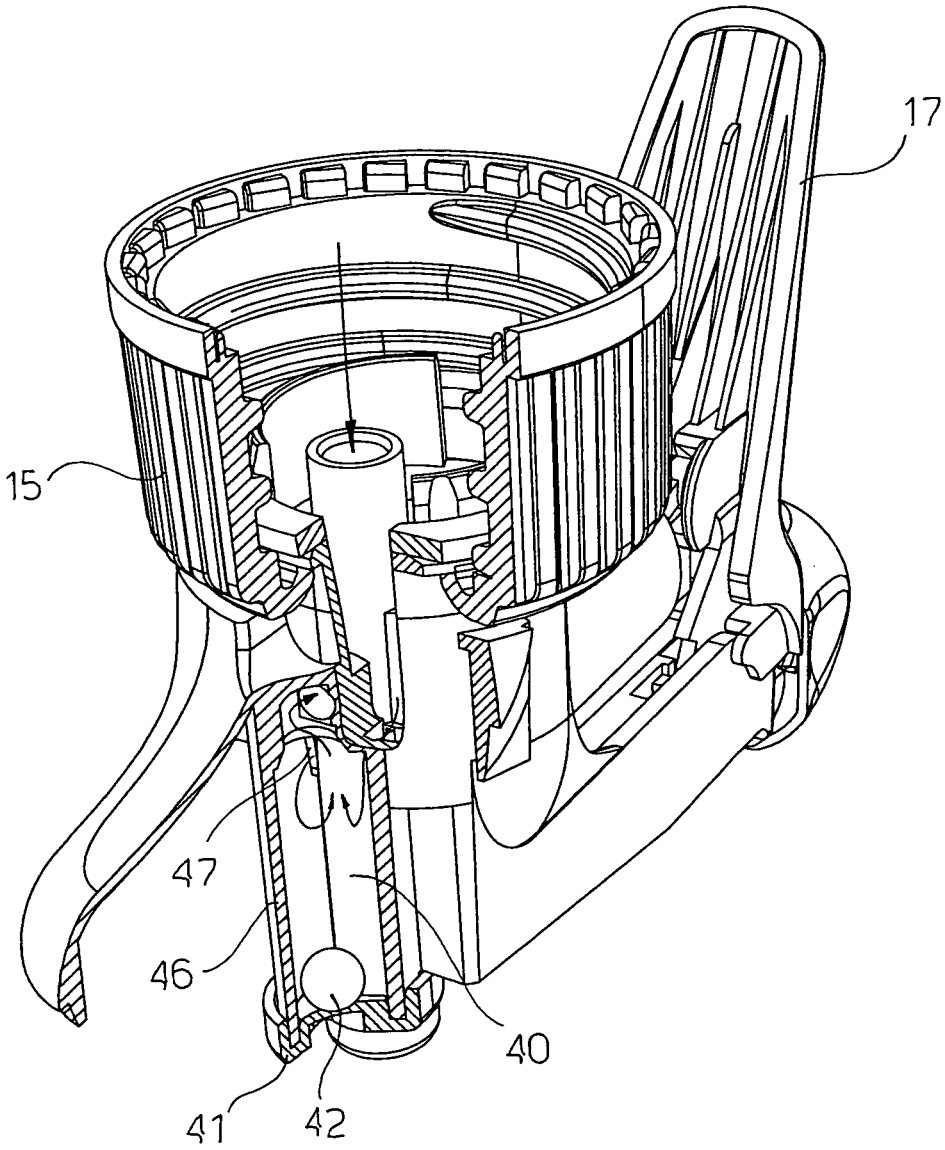

In the wall 46 of the chamber 40, above the ball 42, there are provided slots or windows 47, visible in FIGS. 3 and 4 which put the chamber 40 directly into communication with the inside of the liquid container through respective secondary channels.

Operation of the sprayer in the Up and Down position is as follows.

In the Up position (FIG. 1), the ball 42 is pressed against the conical surface 43 by the pressure difference that is created during the suction step, together with the weight of said ball, thus keeping the hole 44 on the bottom of the chamber 40 closed and allowing normal operation of the sprayer, with suction of the liquid from the inside of the container through the dip tube 25.

Figure 2:
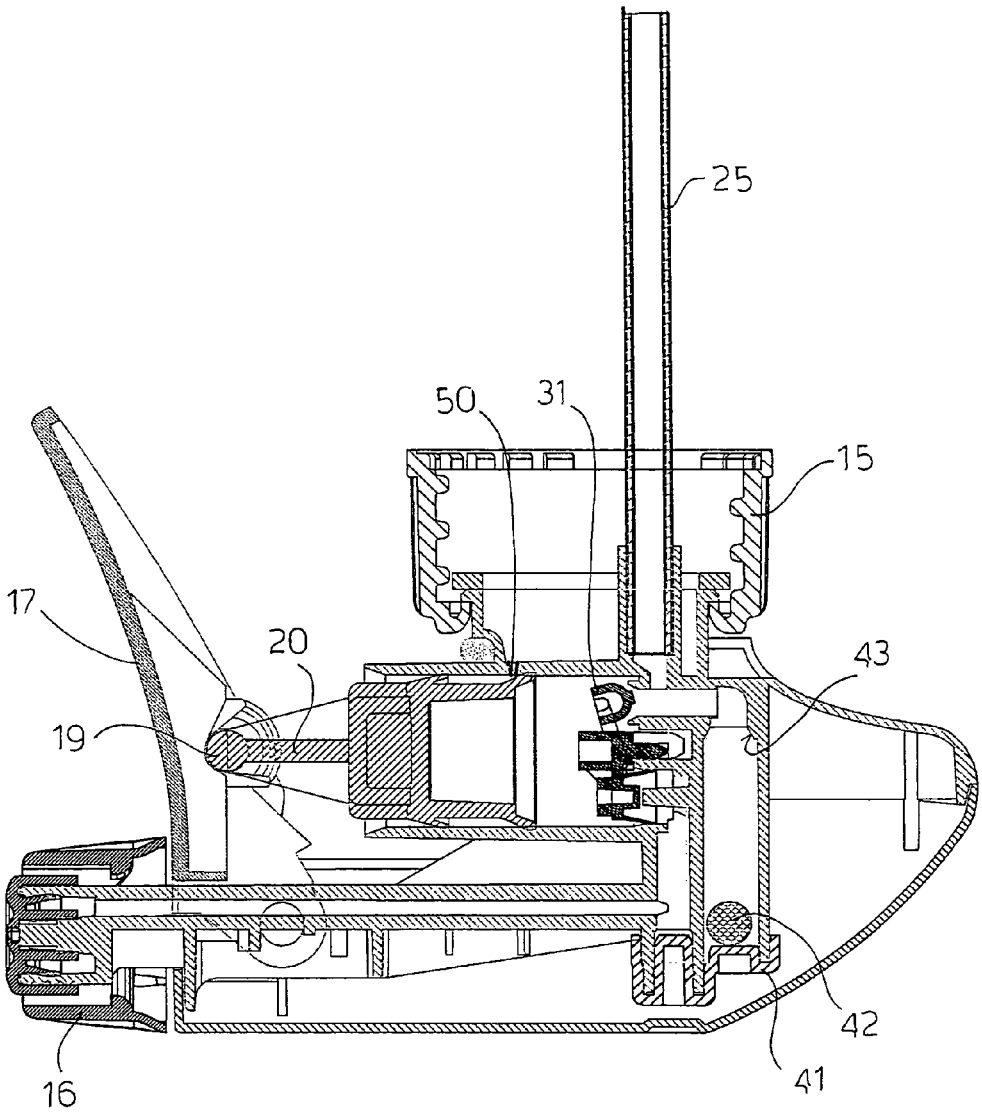
FIG. 2 is view like that of FIG. 1 with the sprayer in the upside-down operating condition (Down position)

In the Down position (FIGS. 2 and 4) the ball 42 falls by gravity to the other end of the chamber 40, where the stopper 41 is provided, freeing the hole 44 and putting the windows 47 into communication with the inlet hole 24 of the pump through the duct 45.

In this position the chamber 40 is flooded with the liquid that enters through the windows 47 and is then sucked by vacuum into the chamber 22 of the pump following operation of the trigger lever 17 during the return step of the plunger 21, through the effect of elastic means not described.

When the sprayer is brought back to the normal operating condition (Up position), the liquid contained in the USD chamber 40 falls back into the container, the ball 42 is positioned on the conical seat 43 again and the sprayer can operate normally by sucking the liquid from the container through the dip tube 25.

Since the windows 47 in the wall of the chamber 40 are positioned higher up than the ball 42, the chamber 40 is at atmospheric pressure, which is the same as the pressure inside the container. In fact, in a per se known manner, the pressure inside the container is restored to atmospheric pressure at each operation of the trigger lever 17, through an air hole 50 which is situated at the base of the pump body 23 housing the plunger 21. The hole 50 puts the inside of the container into communication with the outside only when the trigger lever 17 is pressed.

From this description the advantages of the sprayer according to the invention are evident, in that with minimal modifications it allows the USD function to be used, without requiring any modification to the filling lines.

Figure 6:
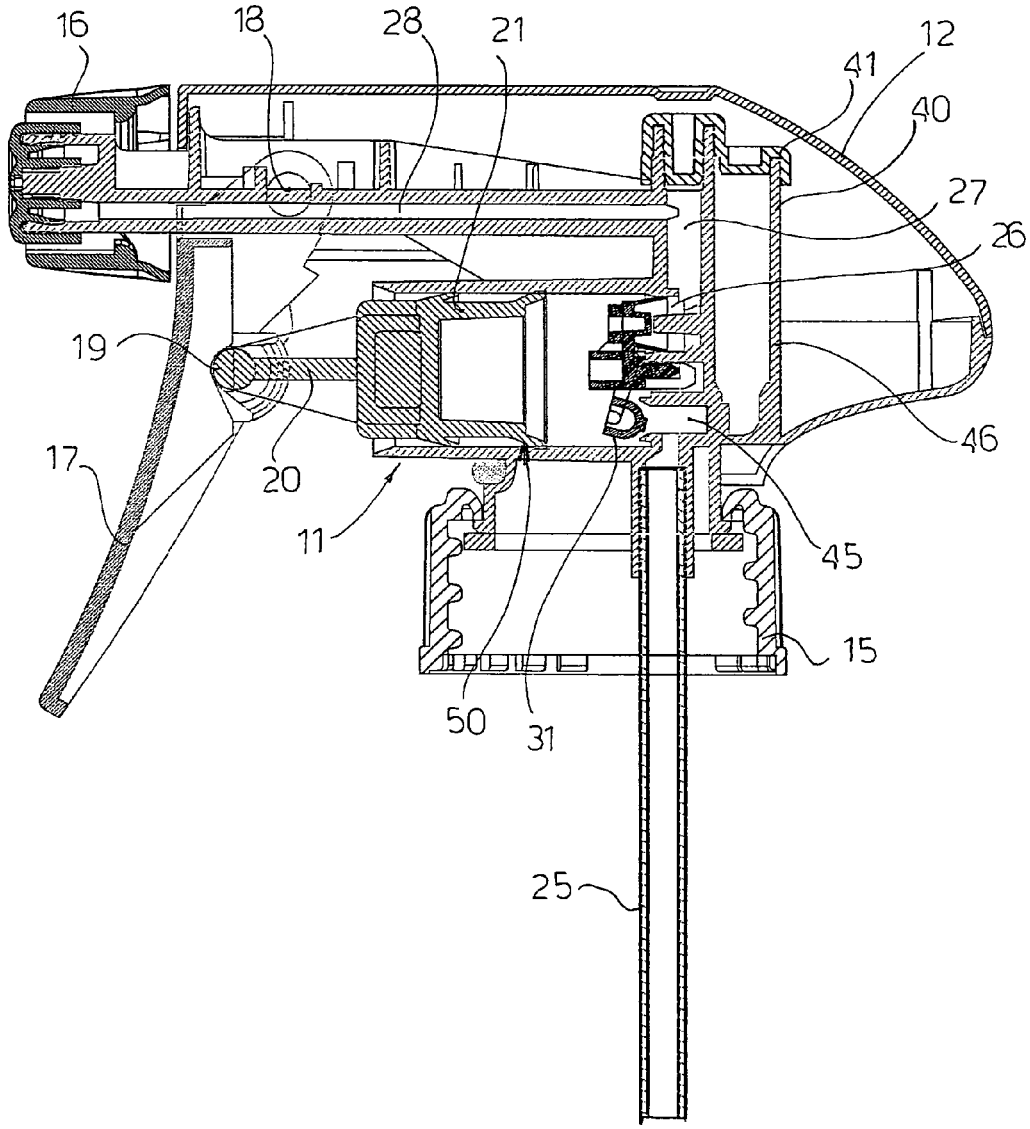
FIG. 6 is a view like FIG. 1, in which the USD has been eliminated.

As confirmation of the simplicity and versatility of the sprayer according to the invention, FIG. 6 shows a version in which the USD function has been eliminated, simply by closing the hole 44 provided on the bottom of the chamber 40 and the windows 47 provided on the wall 46 of said chamber, during moulding.

As stated, the ball 42 is preferably of plastic material, essentially like the other components of the sprayer, so as to allow complete recycling thereof. Obviously it is not ruled out that the ball might be of metal material if the end use of the sprayer so requires.

Of course the invention is not limited to the particular embodiments previously described and illustrated in the appended drawings, but numerous modifications of detail within the reach of a person skilled in the art can be made thereto without thereby departing from the scope of the invention as set forth in the appended claims.

The invention claimed is:

1. A sprayer, comprising:

a body provided with a base that can be applied to a mouth of a container for liquid and a delivery nozzle from which the liquid is sprayed, a pumping chamber being formed in said body, which is in communication with an inside of the container through an inlet hole and a dip tube, and with the delivery nozzle through an outlet hole and a duct having a vertical portion disposed rearward of the pumping chamber and a horizontal portion disposed in the upper part of the body;

a trigger lever hinged to the body of the sprayer and to a stem of a plunger tightly slidable in said pumping chamber;

a one-way suction and delivery valve cooperating with said inlet hole and said outlet hole to control suction of the liquid from the container and delivery of the liquid towards the delivery nozzle following operation of said trigger lever;

a chamber, closed at the top and integral with said body, disposed rearward of said pumping chamber, and extending parallel to and in contact with said vertical portion of the liquid outlet duct, said chamber having at least one hole that puts said chamber into communication with the pumping chamber through said inlet hole, and at least one window that puts said chamber into communication directly with the inside of the container, a closing means being provided to close said hole when the sprayer is in an upright position to free said hole when the sprayer is in an upside down position, allowing the liquid to flow from the inside of the container to the pumping chamber through said at least one window.

2. A sprayer according to claim 1, wherein said chamber comprises a substantially cylindrical chamber.

3. A sprayer according to claim 1, wherein said hole is provided at the bottom of said chamber and said closing means comprises a ball housed in a conical seat above said hole, said windows being provided in a wall of the chamber above said conical seat of the ball.

4. A sprayer according to claim 3, wherein said hole communicates with the inlet hole to the pumping chamber through a short horizontal duct into which said dip tube opens.

5. A sprayer according to claim 3, wherein said ball is made of plastic material.

6. A sprayer according to claim 3, wherein said ball is made of metal material.

7. A sprayer according to claim 1, wherein said chamber is closed at the top by a stopper.

8. A sprayer according to claim 7, wherein said stopper is formed integrally with a covering cap of the body of the sprayer.

9. A sprayer according to claim 1, wherein the sprayer is applied to the mouth of a container by a threaded fixing ferrule.

10. A sprayer according to claim 1, wherein the sprayer is applied to the mouth of a container by a bayonet coupling.

11. A sprayer, comprising:

a pump body;

a chamber defined by the pump body;

an entry hole in a rear wall of the chamber;

an outlet hole in a rear wall of the chamber;

a one-way suction and delivery valve fitted to the entry hole and outlet hole;

a cylindrical chamber in communication with the entry hole, comprising:

a closed top;

a hole in the bottom of the cylindrical chamber;

a conical seat adjacent the hole;

a ball;

at least one window through a wall of the cylindrical chamber; and wherein the top is closed by a portion of a covering cap.

12. The sprayer of claim 11, wherein the top is closed by a stopper.

13. The sprayer of claim 11, wherein the ball comprises a ball made of a material selected from the group consisting of metal and plastic.

14. The sprayer of claim 11, wherein the at least one window comprises a window through the cylindrical chamber wherein the window is above the ball when the sprayer is in an upright position.

15. The sprayer of claim 11, wherein the at least one window comprises a window through the cylindrical chamber wherein the window is above the ball when the sprayer is in an upside-down position.

* * * * *